US005403168A

United States Patent [19]

Evenson

[11] Patent Number: 5,403,168

[45] Date of Patent: Apr. 4, 1995

[54] DOUBLE ACTING PUMP HAVING INLET AND OUTLET POPPET VALVES

[75] Inventor: W. Randall Evenson, Houston, Tex.

[73] Assignee: Bayou City Pump Works, Inc., Houston, Tex.

[21] Appl. No.: 42,785

[22] Filed: Apr. 6, 1993

[51] Int. Cl.[6] ..... F01B 21/02

[52] U.S. Cl. ..... 417/536; 417/900; 92/141; 137/522

[58] Field of Search ..... 417/534, 535, 536, 900, 417/401, 402, 397, 568; 92/141; 137/522

[56] References Cited

U.S. PATENT DOCUMENTS

| | | | |
|---|---|---|---|
| 1,410,994 | 3/1922 | Carter | 417/536 |
| 1,481,358 | 1/1924 | Dwyer | 417/536 |
| 2,023,250 | 12/1935 | Stalder | 417/535 |
| 2,239,727 | 4/1941 | Mayer . | |
| 2,699,153 | 1/1955 | Russell . | |
| 3,256,827 | 6/1966 | Smith . | |
| 3,622,250 | 11/1971 | Conlee . | |
| 4,104,008 | 8/1978 | Hoffmann et al. | 417/401 |
| 4,282,896 | 8/1981 | Makino | 137/522 |
| 4,295,801 | 10/1981 | Bennet | 417/397 |
| 4,591,314 | 5/1986 | Weber | 137/522 |
| 4,981,418 | 1/1991 | Kingsford et al. | 417/397 |
| 5,094,596 | 3/1992 | Erwin . | |
| 5,145,340 | 9/1992 | Allard | 417/568 |

FOREIGN PATENT DOCUMENTS

| | | | |
|---|---|---|---|
| 1334354 | 5/1962 | France | 417/536 |
| 0070952 | 9/1946 | Norway | 417/536 |
| 0298698 | 10/1928 | United Kingdom | 137/522 |

*Primary Examiner*—Richard A. Bertsch
*Assistant Examiner*—M. Kocharov
*Attorney, Agent, or Firm*—Brady, O'Boyle & Gates

[57] ABSTRACT

A double acting pump having inlet and outlet poppet valves clamped to the pump housing in proximity to an inlet manifold and an outlet manifold. The end portion of each cylinder in the double acting pump is provided with a sloped wall to prevent debris in the pumped fluid from becoming stuck in the pump cylinder. Each poppet includes a valve housing having a spring biased valve head slidably mounted therein and engageable with a removable valve seat. A stem is connected to the valve head and extends through an end wall of the valve housing to the exterior thereof to function as an external indicator rod to indicate the position of the valve head within the valve body. A handle is connected to the stem so that the stem can be manually pulled to lift the valve head from the seat to check the operation of the poppet valve, and a disc is mounted on the stem a predetermined distance from the end wall when the valve is in the closed position so that the wear between the valve seat and head can be obtained. The valve seat is dimensioned to allow a substantially unrestricted flow of fluid therethrough and having a 45° slope engageable by a 90° edge on the valve head to minimize the surface area between the valve head and seat so that debris cannot be trapped between the valve head and seat to prevent the valve head from properly seating.

7 Claims, 3 Drawing Sheets

DOUBLE ACTING PUMP HAVING INLET AND OUTLET POPPET VALVES

BACKGROUND OF THE INVENTION

Various air operated, double acting, piston pumps having poppet valves mounted in the inlet and the outlet of the pump have been proposed, as evidenced by U.S. Pat. Nos. 2,239,727; 2,699,153; 3,256,827; 3,622,250; and 5,094,596.

While these pumps have been generally satisfactory for their intended purposes, they are designed to pump relatively light, clean fluids. If an attempt was made to pump viscous sludges and slurries, or fluid contaminated with sand, rocks, rags, and the like, it has been found that the debris in the fluid being pumped has a tendency to collect around the seat of the poppet valves; thereby preventing a proper seating of the valves, and the construction and arrangement of the pump housing is such that the debris gets stuck or lodged in the housing, thereby rendering the pump inoperative.

To overcome the disadvantages experienced with air operated, double acting piston pumps having poppet valves mounted in the inlet and the outlet of the pump, the pump of the present invention has been devised so that not only can light clean fluids be pumped but also sludges, slurries and fluid contaminated with debris such as sand, rocks, rags, and the like.

SUMMARY OF THE INVENTION

The double acting pump of the present invention comprises, essentially, a pump housing having a bulkhead through which the rod of a double acting piston extends. Conventional air control valves are provided in the bulkhead to cause reciprocation of the double acting piston. The portion of the housing within which each piston of the double acting piston reciprocates forms a pair of pump cylinders having a suction poppet valve and a discharge poppet valve located at the end portion of each pump cylinder. A first manifold communicates the two suction valves and a common suction inlet part, and a second manifold similarly communicates the two discharge valves and a common outlet or discharge port.

The end portion of each cylinder is provided with a sloped or inclined wall to prevent debris in the pumped fluid from becoming stuck in the pump cylinder.

Each poppet valve includes a portion of the pump housing forming a valve body having a removable seat adapted to be clamped in place, whereby it can be easily replaced. The valve seat is narrow and is provided with a 45° slope, while the valve head is provided with a square edge which engages the sloped surface of the valve seat. By this construction and arrangement, the surface area between the valve head and seat is minimized so that particles, such as sand, are displaced from the seat and thus prevented from being trapped between the valve head and seat to prevent the valve head from properly seating.

The valve head is normally spring-biased to a closed position against the valve seat and is provided with a stem slidably mounted in an end cap and extending outwardly therefrom to the exterior of the pump housing, whereby the stem functions as an external indicator rod to indicate the position of the valve head within the valve body. The stem can be manually pulled to lift the valve head from the seat to check the operation of the poppet valve, or to dislodge any particles within the valve without requiring the disassembly of the valve.

A washer is mounted on the external end portion of the valve stem at a predetermined distance from the valve end cap when the valve is in the closed position, whereby an indication of the wear between the valve seat and head can be obtained by a measurement of the distance between the washer and end cap.

Each poppet valve contains other features which will be described hereinafter.

DESCRIPTION OF THE PREFERRED EMBODIMENT

Figure 1:
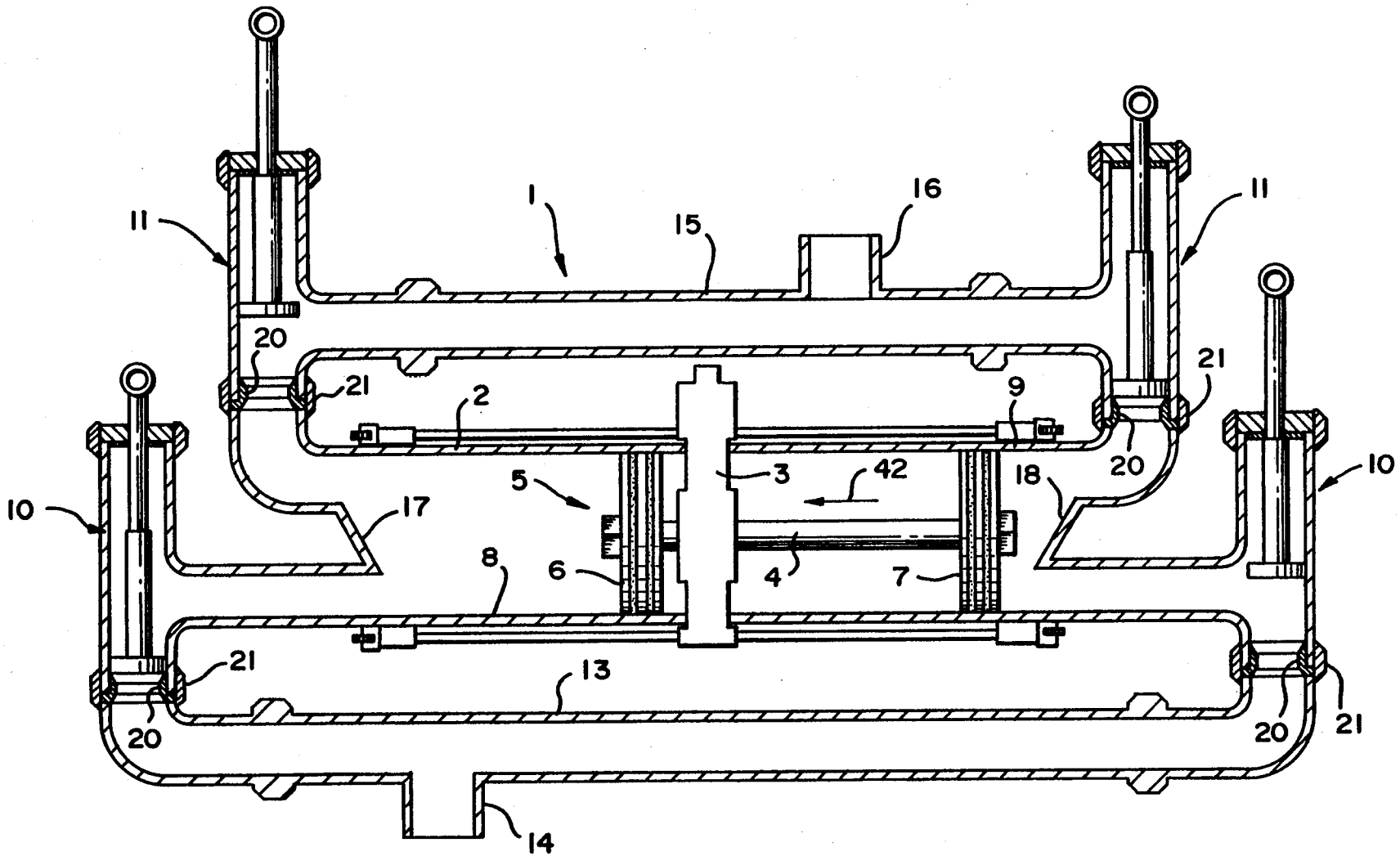
FIG. 1 is a sectional side elevational view of the pump and poppet valves of the present invention.

Referring to the drawings and more particularly to FIG. 1, the double acting pump 1 of the present invention comprises a housing 2 having a bulkhead 3 through which the rod 4 of a double acting piston 5 extends. Conventional air control valves, not shown, are provided in the bulkhead to cause reciprocation of the double acting piston 5. The portion of the housing within which each piston 6 and 7 of the double acting piston 5 reciprocates forms a pair of pump cylinders 8 and 9 having a suction poppet valve 10 and a discharge poppet valve 11 located at the end portion of each pump cylinder 8 and 9. A first manifold 13 communicates the two suction valves 10 with a common suction inlet port 14, and a second manifold 15 similarly communicates the two discharge valves 11 with a common outlet or discharge port 16. The end portion of each pump cylinder 8 and 9 is provided with a sloped or inclined wall 17 and 18 to prevent debris in the pumped fluid from becoming lodged between the piston and pump cylinder end wall.

Figure 2:
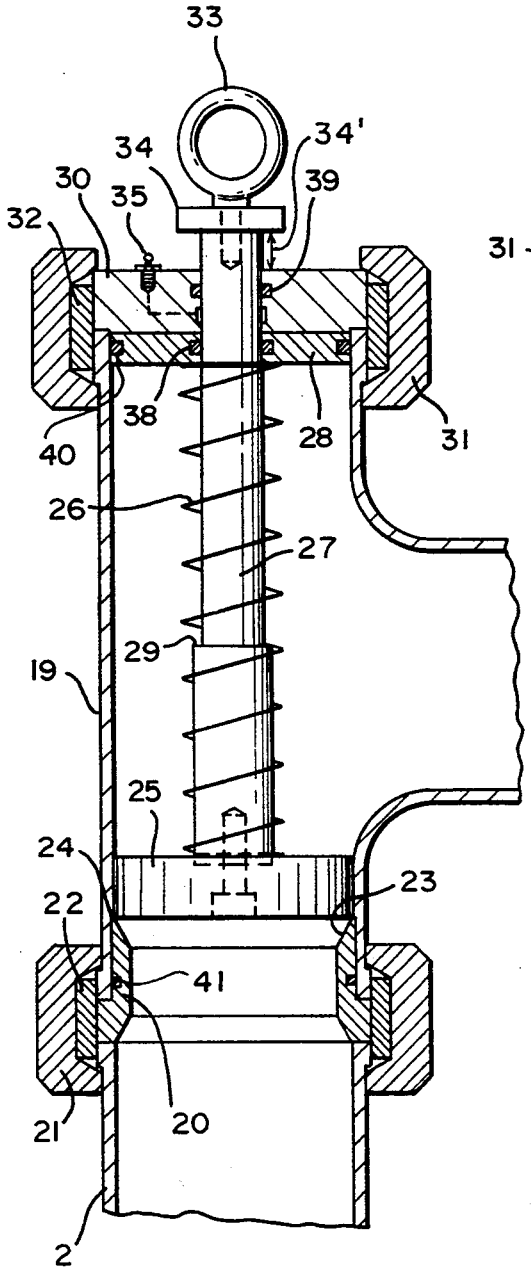
FIG. 2 is a sectional side elevational view showing one of the poppet valves in the closed position.
Figure 3:
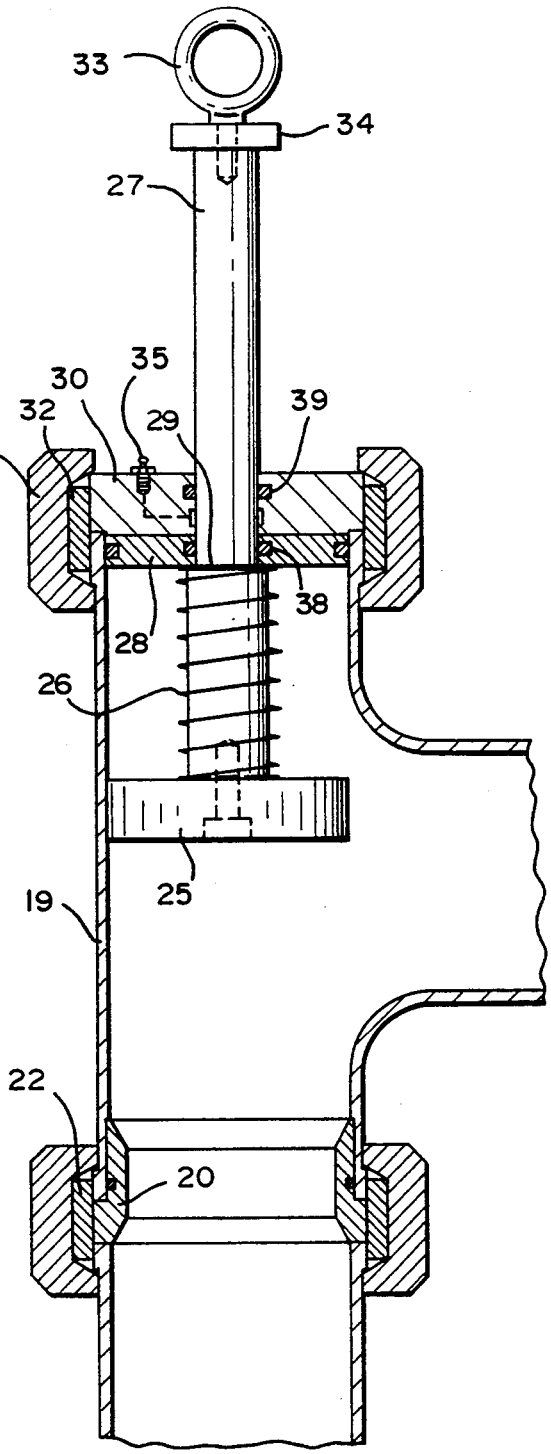
FIG. 3 is a sectional side elevational view showing the valve of FIG. 2 in the open position.

The details of the construction of each poppet valve is shown in FIG. 2, and comprises a valve body 19 having a removable seat 20 mounted on the interior surface of the valve body 19 and secured to a portion of the pump housing 2 by a suitable clamp 21 having a sealing ring 22. The valve seat 20 is dimensioned to allow a substantially unrestricted flow of fluid therethrough and is provided with a 45° slope 23 engageable by a 90° edge 24 on a valve head 25. By this construction and arrangement, the surface area between the valve head 25 and seat 20 is minimized so that particles, such as sand, are displaced from the seat 20 and thus prevented from being trapped between the valve head 25 and seat 20 to prevent the valve head from properly seating. The valve head 25 is biased against the seat 20 by a compression spring 26 mounted coaxially on a valve stem 27 and biased between the valve head 25 and an end wall 28. The valve stem 27 is provided with a shoulder 29 which is adapted to engage the end wall 28, as shown in FIG. 3, when the poppet valve has been moved to the open position, to thereby prevent the spring 26 from being fully compressed, The valve housing 19 is closed by an outer end wall 30 or end cap abutting the end wall 28 in face-to-face relationship and secured to the valve housing by a clamp 31 having a sealing ring 32. The valve stem 27 extends through the end walls 28 and 30 and is provided at its outer end with a handle 33, whereby the valve stem 27 can be manually pulled to lift the valve head 25 from the seat 20 to check the operation of the valve, or to dislodge any particles within the valve without requiring the disassembly of the valve. A washer or disc 34 is mounted on the end of the valve stem 27 adjacent the handle 33 and at a predetermined distance 34' from the end wall 30 when the valve is in the closed position, as shown in FIG. 2, whereby an indication of the wear between the valve seat 20 and valve head 25 can be obtained by a measurement of the distance 34' between the end wall 30 and the disc 34.

By the construction and arrangement of the valve stem 27 extending through the end walls 28 and 30, the stem functions as an external indicator rod to indicate the position of the valve head 25 within the valve body 19, and it also functions as a guide rod to maintain the valve head 25 centrally disposed within the valve housing 19. A close tolerance is maintained between the valve head 25 and the inner surface of the valve housing so that during its reciprocatory movement, the valve head 25 scrapes the inner surface of the valve housing to thereby prevent particles from accumulating between the valve head 25 and valve housing 19 which would cause the valve head to become stuck within the housing.

Figure 4:
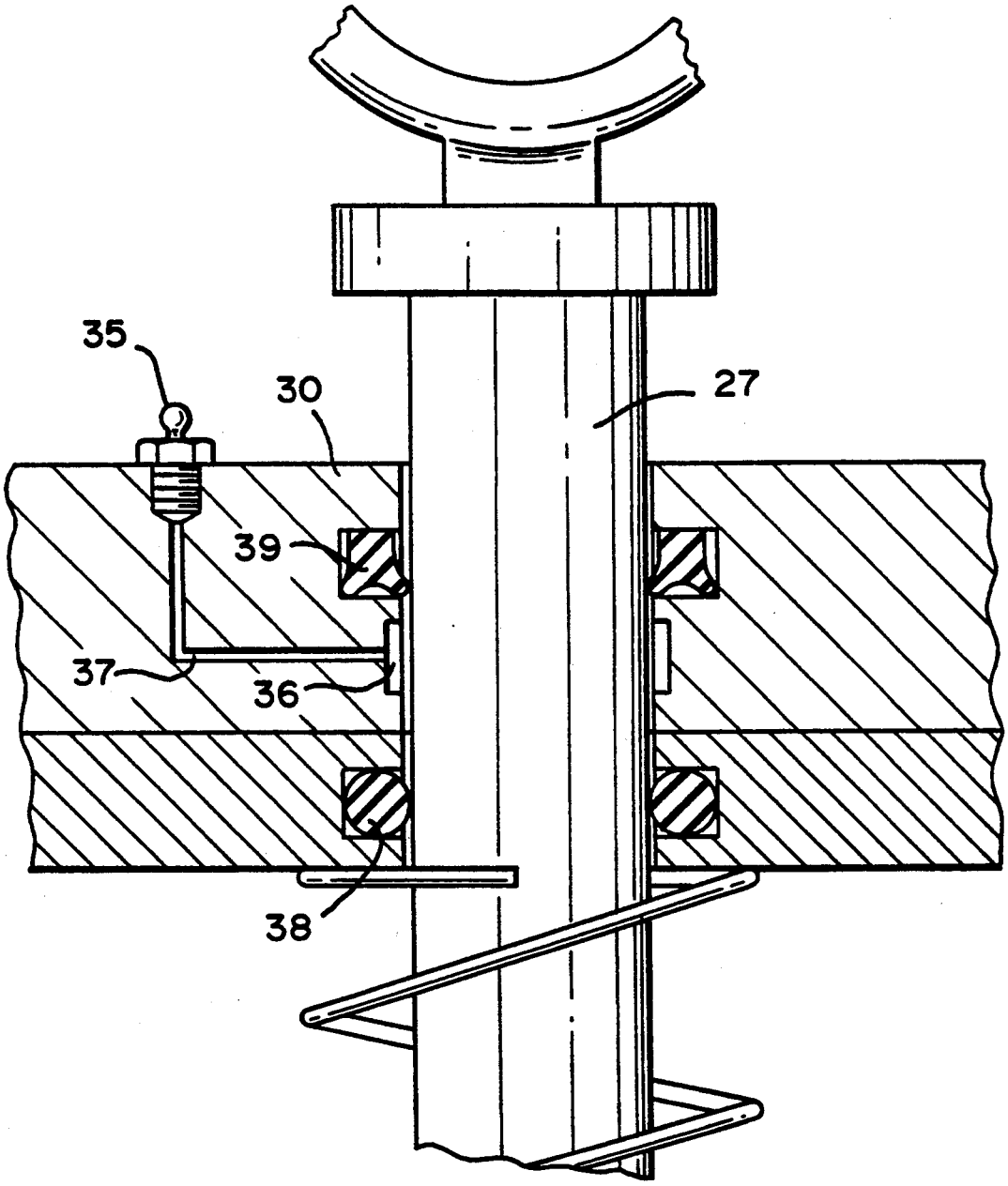
FIG. 4 is an enlarged, fragmentary side elevational view showing the details of the lubrication and seal assembly for the poppet valve stem.

The details of the construction of the lubrication and seal assembly for the poppet valve are shown in FIG. 4, wherein it will be seen that the end wall 30 is provided with a zerk fitting 35 communicating with an annular groove 36 through a passageway 37 provided in the end wall 30. An O-ring 38 is mounted between the end wall bore and valve stem 27 on one side of the annular groove 36, and an annular lip seal 39 is similarly mounted between the end wall bore and valve stem 27 on the opposite side of the annular groove 36. By this construction and arrangement, pressurized grease is forced through the zerk fitting 35 and accumulates in the annular groove 36, whereby the valve stem 27 is coated with a film of grease, and the pressurized grease also forces the O-ring 38 and lip seal 39 against the stem 27. During the reciprocation of the valve stem, a film of the fluid being pumped accumulates on the greased stem 27, and the grease pressure forces the seals 38 and 39 to wipe the grease and film of pumped fluid from the stem, thereby removing the pumped fluid from the stem 27.

To complete the description of the structural details of the poppet valve, as will be seen in FIGS. 2 and 3, additional O-rings 40, 41 are provided between the end wall 28 and valve housing 19, and between the valve seat 20, and housing 19 to further seal against leakage of the fluid being pumped.

In the operation of the pump, as will be seen in FIG. 1, as the double-acting piston 5 reciprocates within the pump housing, the suction poppet valves 10 and discharge poppet valves 11 are reciprocated to the open and closed positions. For instance, when the piston 5 moves in the direction of the arrow 42, the pressure of the fluid being pumped in pump cylinder 8 will cause the suction valve 10 communicating with the pump cylinder 8 to close, while forcing the corresponding discharge valve 11 to the open position, whereby the fluid being pumped is forced through the discharge port 16. During this movement of the piston 5, the pump cylinder 9 becomes a suction chamber causing the poppet valve 10 communicating with the pump cylinder 9 to move to the open position while the corresponding discharge poppet valve 11 is biased to the closed position. At this stage, the fluid to be pumped enters the inlet port 14 and fills the pump cylinder 9 so that when the piston 5 is forced in the opposite direction, the fluid in pump cylinder 9 will bias the suction poppet 10 communicating with the pump cylinder 9 to the closed position, while the corresponding discharge poppet valve 11 is moved to the open position, whereby the pumped fluid is discharged through port 16.

From the above description, it will be readily apparent to those skilled in the art that the double-acting pump and associated inlet and outlet poppet valves of the present invention are improvements over prior air operated, double-acting piston pumps in that the inclined end walls 17 and 18 prevent debris in the pumped fluid from becoming lodged between the piston 5 and pump cylinder end walls. The construction and arrangement of the valve seat 20 and piston 25 in each poppet valve prevents the accumulation of debris on the valve seat, and the use of clamps 21 and 30 to secure the valve seat 20 and end walls 30 on each poppet valve facilitates the disassembly and repair or replacement of the various components of the poppet valve without requiring the complete disassembly of the pump. The "T" configuration of the valve body allows full flow of the fluid being pumped through the valve when in the open position, and allows easy access to the internal components of the valve. All these features cooperate to provide a pump which can pump not only clean fluid but also sludges, slurries and fluid contaminated with debris such as sand, rocks, rags, and the like.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A double acting pump having inlet and outlet poppet valves comprising, a housing, a double acting piston assembly slidably mounted in said housing, said double acting piston assembly having a pair of axially spaced pistons, a piston rod connected between said pistons, a bulkhead mounted in said housing, said piston rod extending through said bulkhead and slidably mounted therein, a pair of pump cylinders formed in the portion of the housing in which each piston reciprocates, each cylinder having an end portion terminating with an end wall, a suction poppet valve and a discharge poppet valve being mounted at the end portion of each pump cylinder, an inlet port provided in said housing, a first manifold communicating said inlet port with each suction poppet valve, a discharge port, a second manifold communicating said discharge port with each discharge poppet valve, the end wall in each cylinder extending inwardly into the cylinder from the end portion thereof and positioned between the suction and discharge poppet valves, the end wall in each cylinder being inclined in a direction to direct the pumped fluid to the discharge poppet valves and to prevent debris in the pumped fluid from becoming lodged between the double acting piston assembly and pump cylinder end wall.

2. A double acting pump having inlet and outlet poppet valves comprising a housing, a double acting piston assembly slidably mounted in said housing, said double acting piston assembly having a pair of axially spaced pistons, a piston rod connected between said pistons, a bulkhead mounted in said housing, said piston rod extending through said bulkhead and slidably mounted therein, a pair of pump cylinders formed in the portion of the housing in which each piston reciprocates, each cylinder having an end portion terminating with an end wall, a suction poppet valve and a discharge poppet valve being mounted at the end portion of each pump cylinder, each poppet valve comprising, a valve body, a removable valve seat mounted on the interior surface of the valve body, a clamp securing the valve body and associated valve seat to the pump housing, a valve head engageable with said valve seat, a stem connected to said valve head, an end wall mounted in said valve body, said stem extending through said end wall and slidably mounted therein, a spring mounted between said end wall and said valve head for biasing said poppet valve to the closed position, whereby the stem functions as an indicator rod to indicate the position of the valve head relative to the valve seat; an inlet port provided in said housing, a first manifold communicating said inlet port with each suction poppet valve, a discharge port, a second manifold communicating said discharge port with each discharge poppet valve, said end wall on the end portion of each cylinder being inclined to prevent debris in the pumped fluid from becoming lodged between the double acting piston assembly and pump cylinder end wall.

3. A double acting pump according to claim 2, wherein a handle is connected to the end of the stem extending outwardly from the valve housing, whereby the poppet valve can be manually actuated to check the operation of the poppet valve.

4. A double acting pump according to claim 2, wherein a disc is mounted on the stem exteriorly of the valve housing and positioned a predetermined distance from the end wall when the valve is in the closed position, whereby an indication of the wear between the valve seat and valve head can be obtained by a measurement of the distance between the end wall and the disc.

5. A double acting pump according to claim 2, wherein the spring is mounted coaxially on the valve stem, a shoulder provided on said stem engageable with the end wall when the valve head has been moved to the open position, to thereby prevent the spring from being fully compressed.

6. A double acting pump according to claim 2, wherein the valve seat is dimensioned to allow a substantially unrestricted flow of fluid therethrough, said seat having a 45° slope, said valve head having a 90° edge engageable with said seat slope, whereby the surface area between the valve head and seat is minimized so that particles are displaced from the seat thus being prevented from being trapped between the valve head and seat to prevent the valve head from properly seating.

7. A double acting pump according to claim 2, wherein lubrication and seal assemblies are mounted on said end wall, said lubrication assembly comprising, a lubricant fitting connected to said end wall, an annular groove formed in said end wall surrounding said stem, a passageway provided in said end wall communicating said lubricant fitting with said annular groove, whereby lubricant is supplied through said fitting to said annular groove; said seal assembly comprising an O-ring mounted in said end wall and surrounding said stem, a lip seal mounted in said end wall and surrounding said stem, said annular groove being positioned between said O-ring and said lip seal, whereby pressurized lubricant forces the O-ring and lip seal against the stem.

* * * * *